United States Patent [19]

Cordes

[11] 4,448,105

[45] May 15, 1984

[54] DRUM CONSTRUCTION

[76] Inventor: Charles P. Cordes, 27 Kenneth Pl., Clark, N.J. 07066

[21] Appl. No.: 429,635

[22] Filed: Sep. 30, 1982

[51] Int. Cl.[3] ..... G10D 13/02

[52] U.S. Cl. ..... 84/413; 84/411 R

[58] Field of Search ..... 84/411–421

[56] References Cited

U.S. PATENT DOCUMENTS

| | | | |
|---|---|---|---|
| 1,254,756 | 1/1918 | Wilson | 84/411 R |
| 2,990,745 | 7/1961 | Casavant | 84/421 |
| 3,981,220 | 9/1976 | Clark | 84/415 |
| 4,214,504 | 7/1980 | Rex | 84/411 R |
| 4,334,458 | 6/1982 | Grauso | 84/411 R |

*Primary Examiner*—Lawrence R. Franklin

*Attorney, Agent, or Firm*—Sughrue, Mion, Zinn, Macpeak and Seas

[57] ABSTRACT

A drum construction is provided with a bottom ring having a plurality of projections extending outwardly therefrom at equally spaced locations about the circumference thereof for supporting tubes of proper length according the the drum shell depth. The tubes have internal threads on both ends which accept the tension screws for connecting the top and bottom hoops to the ring. A drum shell is clamped between the bottom ring and the top hoop and is completely free of holes and does not have any hardware attached thereto thereby providing only a minimum dampening effect. The shell is located concentrically on the upper surface of the bottom ring by means of shaped washers which are held in place by lock nuts on the tube ends. Auxiliary support brackets may be clamped to adjacent tubes in spaced relation to the shell so as not to adversely affect the tonal characteristics of the shell.

4 Claims, 5 Drawing Figures

FIG. 1
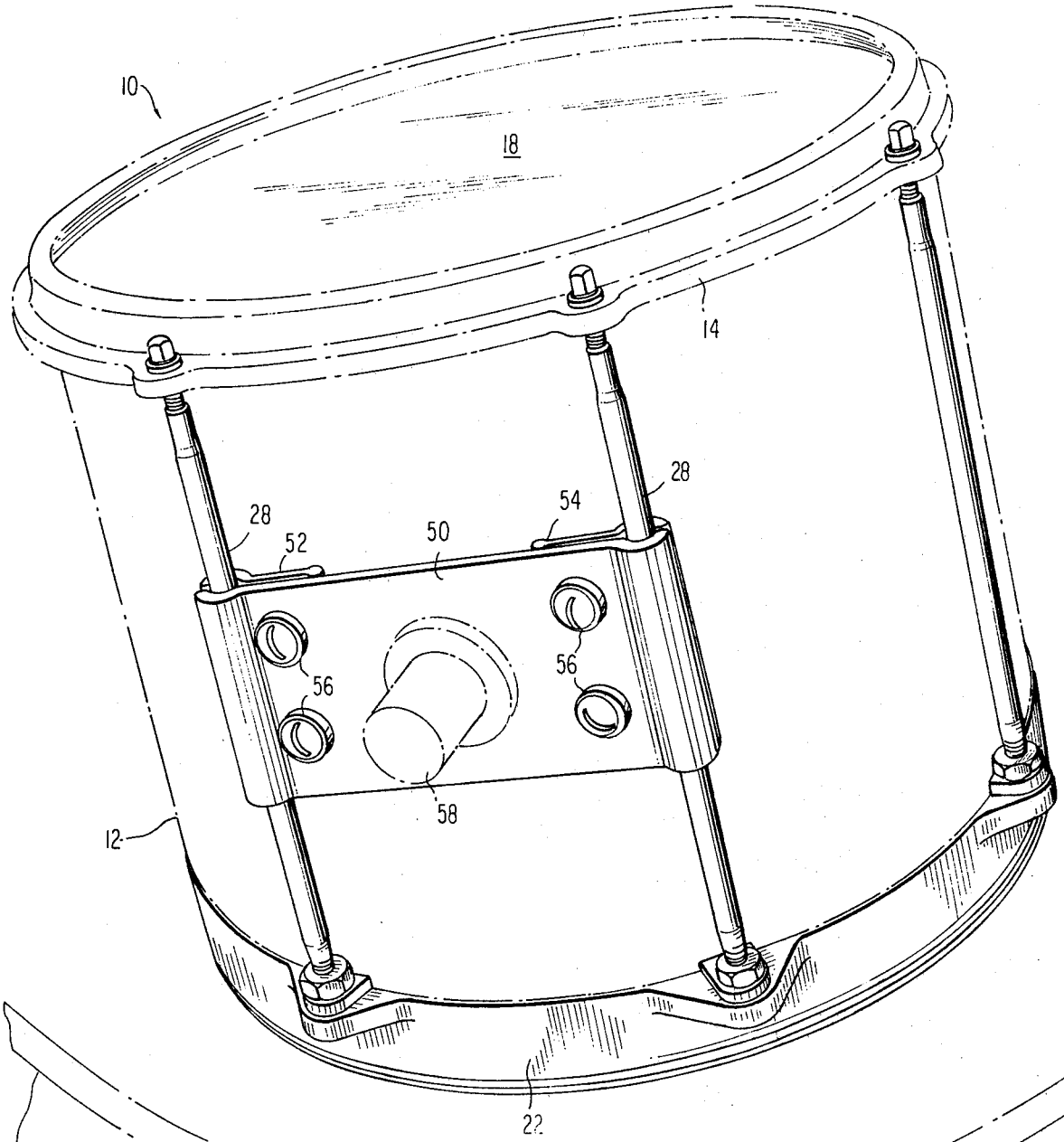
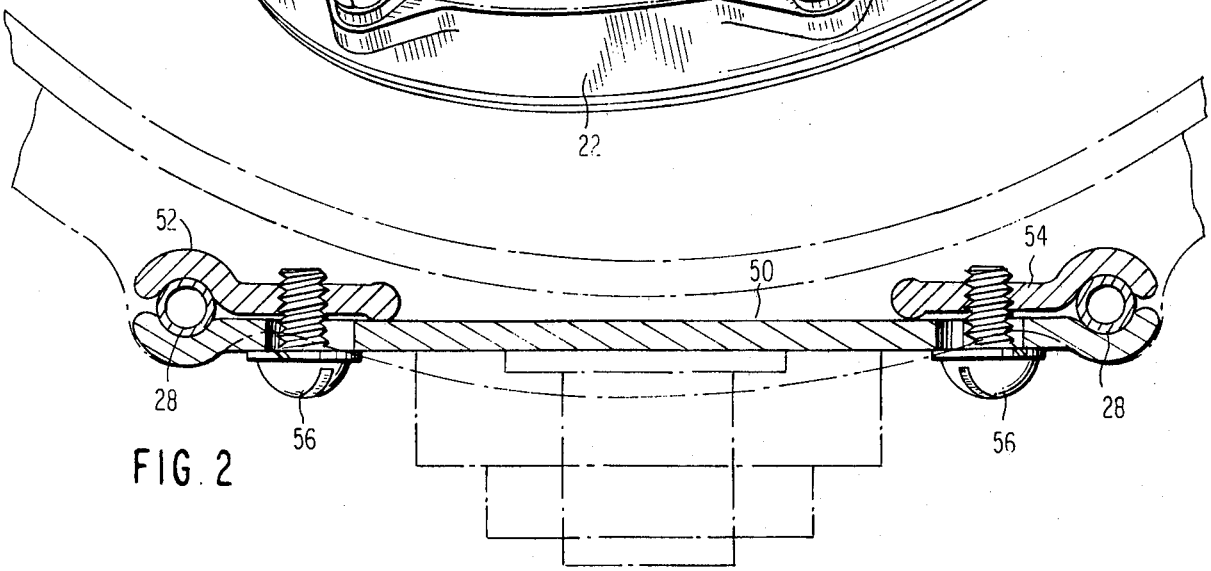
FIG. 2

FIG. 3
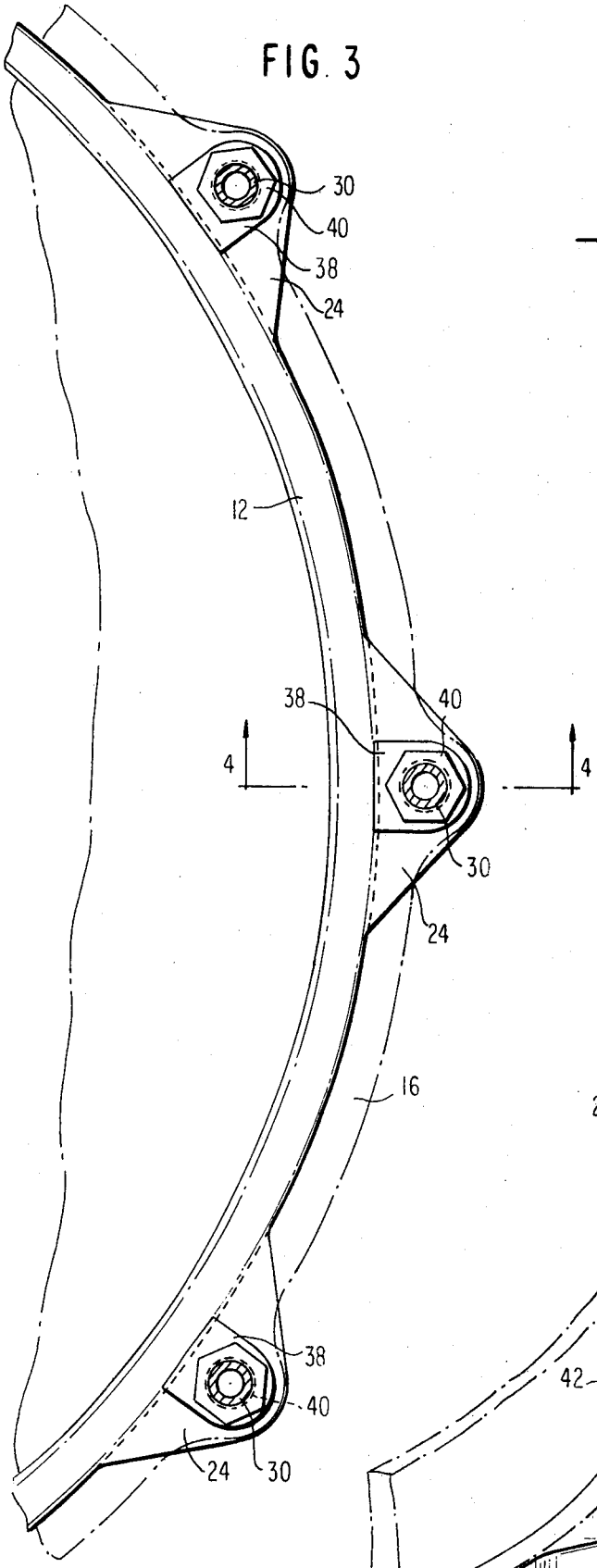
FIG. 4
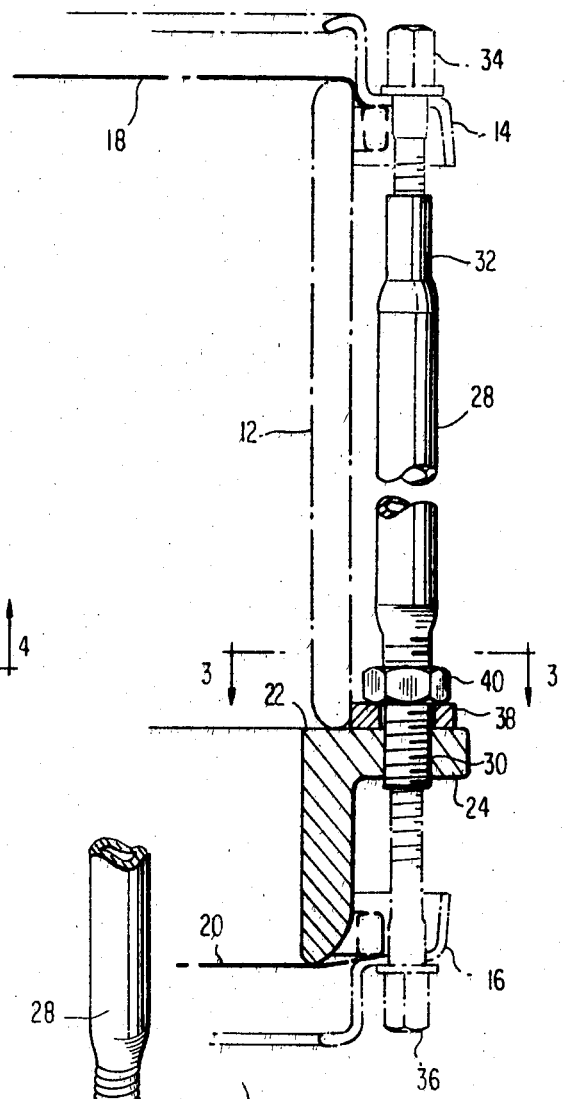
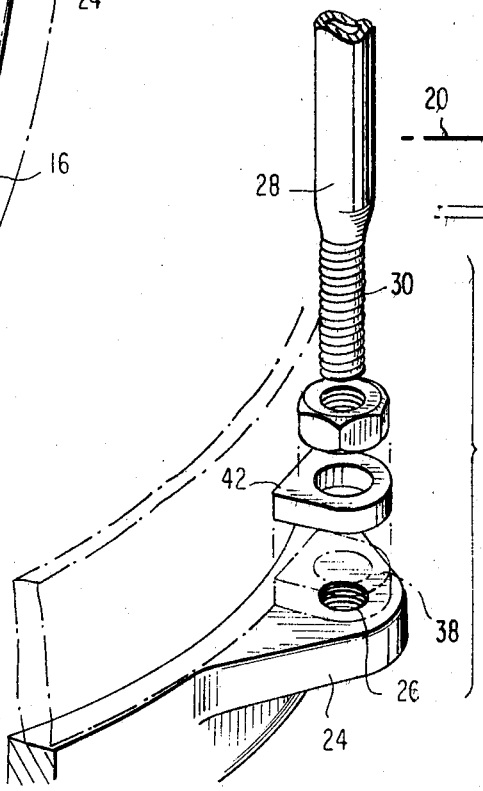
FIG. 5

DRUM CONSTRUCTION

BACKGROUND OF THE INVENTION

The present invention is directed to an improved drum construction and more specifically to a tensioning ring adapted to support the bottom edge of a drum shell and which is provided with means for supporting a plurality of tensioning tubes about the circumference of the shell for engagement with the top and bottom hoops wherein none of the elements are secured directly to the drum shell.

A conventional drum consists of a drum shell with casings for blocks attached to it. The casings carry screw inserts and tension rods pass through the hoop into the screw inserts for causing the drum head to be tensioned. The casings clamped to the drum shell damp or muffle the vibrations in the shell proper. An example of such a conventional construction is disclosed in the U.S. Pat. to Wilson, No. 1,254,756, which shows the ring to which the top and bottom hoops are secured by means of a plurality of screws at spaced circumferential locations. The ring is secured to the drum shell by means of screws. Such a direct attachment of the ring to the drum shell will dampen or muffle the vibrations in the shell.

SUMMARY OF THE INVENTION

The present invention provides a new and improved drum construction wherein none of the elements constituting the tensioning means for the drum heads or the means for mounting the snares or other attachments are secured directly to the drum shell thereby overcoming the abovementioned tonal problems.

The present invention provides a new and improved drum construction comprised of a bottom ring having a plurality of projections or ears extending outwardly therefrom at equally spaced locations about the circumference thereof for supporting tubes of proper length according to the drum shell depth. The tubes have internal threads on both ends which accept the tension screws for connecting the top and bottom hoops to the ring. The drum shell is completely free of holes and does not have any hardware attached thereto. The drum shell proper is clamped between the bottom ring and the batter head thereby providing only a minimal dampening effect. The shell is located concentrically on the upper surface of the bottom ring by means of shaped washers which are held in place by lock nuts on the tube ends. Auxiliary support brackets may be clamped to adjacent tubes in spaced relation to the shell so as not to adversely affect the tonal characteristics of the shell.

The foregoing and other objects, features and advantages of the invention will be apparent from the following more particular description of the preferred embodiment of the invention as illustrated in the accompanying drawings.

BRIEF DESCRIPTION OF THE DRAWINGS

FIG. 1 is a perspective view of the drum construction according to the present invention.

FIG. 2 is a partial sectional view through the auxiliary mounting bracket and the adjacent tubes to which it is clamped.

FIG. 3 is a partial sectional view taken along the lines 3—3 in FIG. 4.

FIG. 4 is a partial sectional view taken along the lines 4—4 in FIG. 3.

FIG. 5 is an exploded view showing the attachment of a tube and centering washer to a projecting tab of the bottom ring.

DETAILED DESCRIPTION OF THE INVENTION

The drum 10 according to the present invention is comprised of a shell 12, a top hoop 14, a bottom hoop 16, a beater head 16, a snare head 20, and a bottom support ring 22 as seen in FIG. 4.

The drum shown in FIG. 1 is known as a tom-tom and is not provided with a snare head and bottom hoop. In both constructions the shell 12 is supported by the bottom ring 22 and is clamped between the bottom ring 22 and the batter head 14 by means of a tensioning arrangement.

The tensioning arrangement according to the present arrangement is comprised of a plurality of equally spaced laterally extending ears 24 on the bottom ring 22. Each of the ears 24 is provided with a threaded aperture 26 into which the lower threaded end 30 of a tensioning tube 28 is screwed. The upper end of each tensioning tube 28 is provided with a reduced diameter end portion 32 having internal threads which mate with the threads of a tensioning screw 34 which passes through an aperture in the top hoop 14. The lower end 30 of each tensioning tube 28 is also provided with internal threads which mate with the threads of a tensioning screw 36 which passes through an aperture in the bottom hoop 16. Thus, by rotating the tension screws 34 and 36 in the ends of the tensioning tube 28, the tension of the top and bottom hoops may be adjusted to vary the tension of the respective heads.

A spacing washer 38 is provided with a non-threaded aperture which allows the washer to be closely fitted over the lower end 30 of the tensioning tube 28. The washer is adapted to rest on the upper surface of the bottom ring 22 and it is held in place by means of a lock nut 40 threaded on the lower end 30 of the tensioning tube 28. The lock nut 40 also serves to secure the tensioning tube 28 in its adjusted position relative to the bottom ring 22. The washer 38 is provided with a substantially flat surface 42 which engages the shell. Thus, the plurality of circumferentially placed washers will position the shell 12 concentrically on the upper surface of the bottom ring 22.

In order to mount the tom-tom illustrated in FIG. 1 on a suitable support a mounting bracket 50 is clamped on to adjacent tensioning tubes 28 by means of a pair of clamping plates 52 and 54 which are secured to the bracket 50 by means of screws 56. A mounting projection 58 is secured to the bracket 50 by any suitable means.

In the drum construction illustrated in FIG. 4 having a snare head 20 a pair of mounting brackets 50 may be secured to tensioning tubes 28 on diametrically opposite sides of the shell 12 for supporting a conventional snare device (not shown) in operative engagement with snare head 20.

In summary, the drum or tom-tom construction according to the present invention utilizes a bottom support ring to which the tensioning tubes may be secured thereby eliminating the necessity for any screws or other fastening means penetrating or even contacting the drum shell. Any auxiliary device, such as a mounting bracket for a tom-tom or a mounting bracket for a conventional snare device are mounted in spaced relation to the drum head on the tensioning tubes so as not to affect the tonal quality of the drum shell.

While the invention has been particularly shown and described with reference to a preferred embodiment thereof, it will be understood by those in the art that various changes in form and details may be made therein without departing from the spirit and scope of the invention.

What is claimed is:

1. A drum comprising an annular shell having top and bottom edges, supporting ring means disposed in abutting enagement with said bottom edge of said shell and having a plurality of laterally outwardly extending ears spaced equidistantly about the circumference of said support ring means with each ear having a threaded aperture extending therethrough, a head disposed in engagement with the top edge of said shell, a top hoop disposed in engagement with said head and having a plurality of apertures extending through said top hoop at equally spaced intervals about the circumference of said top hoop, a plurality of tensioning means adjustably interconnected between said top hoop and said support ring means comprising a plurality of hollow tubes each having internal threads at opposite ends thereof and external threads at the lower end thereof for a complimentary engagement with the threaded aperture in said support ring means, thension screw means extending through said apertures into threaded engagement with each of said tubes, a head disposed in engagement with said support ring means below said ears, a bottom hoop having a plurality of apertures therethrough and tension screw means adapted to pass through said apertures into threaded engagement with the end of each tube engaged in said ears.

2. A drum as set forth in claim 1 further comprising bracket means for supporting auxiliary devices extending between and overlying two adjacent tensioning means and clamping means secured to said bracket means for securing said bracket means to said tensioning means in spaced relation to said shell.

3. A drum as set forth in claim 1 further comprising shell locating washer means mounted on each of said tubes in engagement with said ears on said support ring means and having a substantially flat surface disposed in abutting engagement with said shell to concentrically locate said shell on said support ring means.

4. A drum as set forth in claim 1 wherein said annular shell is imperforate.

* * * * *